United States Patent [19]

Fischer

[11] 4,284,695

[45] Aug. 18, 1981

[54] METHOD OF MANUFACTURING LUMINESCENT SCREENS FOR COLOR-PICTURE TUBES WITH TWO EXPOSURES

[75] Inventor: Bruno Fischer, Esslingen, Fed. Rep. of Germany

[73] Assignee: International Standard Electric Corporation, New York, N.Y.

[21] Appl. No.: 109,387

[22] Filed: Jan. 3, 1980

[30] Foreign Application Priority Data

Jan. 20, 1979 [DE] Fed. Rep. of Germany ..... 2902239

[51] Int. Cl.[3] ..... G03C 5/00

[52] U.S. Cl. ..... 430/24; 354/1; 430/26; 430/394; 430/396; 430/494

[58] Field of Search ..... 430/24, 26, 394, 396, 430/494; 354/1

[56] References Cited

U.S. PATENT DOCUMENTS

| | | | |
|---|---|---|---|
| 2,717,545 | 9/1955 | Engeler | 355/84 |
| 3,005,708 | 10/1961 | Hesse | 430/24 |
| 3,287,130 | 11/1966 | Kaplan | 430/24 |
| 3,762,284 | 10/1973 | Paak et al. | 430/24 X |
| 4,013,467 | 3/1977 | Hosokoshi et al. | 430/24 |
| 4,045,224 | 8/1977 | Yamazaki et al. | 354/1 X |
| 4,132,470 | 1/1979 | Van Heek | 430/24 X |

FOREIGN PATENT DOCUMENTS 2440575 3/1975 Fed. Rep. of Germany .

*Primary Examiner*—Edward C. Kimlin

*Attorney, Agent, or Firm*—John T. O'Halloran; Thomas N. Twomey

[57] ABSTRACT

A phosphor-containing layer (2) deposited on the glass faceplate (1) of a color-picture tube is hardened by exposure to light in two steps in order to obtain an amount of light varying from point to point on the glass faceplate and to realize sharp-edged phosphor strips having only slight width variations. In the first step, the main portion of the amount of light required to harden the layer is allowed to fall on the layer without affecting the position-dependent light distribution, and in the second step the layer is exposed essentially to the position-dependent amount of light required to complete the necessary total amount of light.

7 Claims, 2 Drawing Figures

METHOD OF MANUFACTURING LUMINESCENT SCREENS FOR COLOR-PICTURE TUBES WITH TWO EXPOSURES

The present invention relates to a method of manufacturing luminescent screens for color-picture tubes, wherein a light-sensitive layer is exposed through the shadow mask of the tube.

With such a method, which is described, for example, in German Offenlegungschrift (DE-OS) No. 24 40 575, stripes of phosphor are to be produced which vary in width within only narrow limits. An apparatus for carrying out such a method is indicated in FIG. 1 of the accompanying drawing. On the glass faceplate 1 is a light-sensitive layer of luminescent material 2, which is exposed through the shadow mask 3 to the light source 4. The light beams are designated 5. By a lens 6, the light path is reproduced so as to correspond to the electron-beam path in the finished tube. On the screen, phosphor stripes of substantially constant width are to be achieved. However, the transparency of the mask varies considerably, e.g. from the center toward the edge. In addition, the thickness and temperature of the light-sensitive layer of luminescent material applied in the screening process are dependent on the screen position. For all these reasons, a filter 7 is used which is located on, directly below or, as shown in FIG. 1, directly above the lens 6. This filter influences the intensity of the light beams so that phosphor stripes of only slightly varying width are achieved. As a rule, the filter transmission at the edge is considerably higher than that at the center.

The filter usually consists of a gelatin-soot coating on glass. The production of such a coating is described in detail in DE-OS No. 20 36 684.

If a screen is exposed through such a filter, phosphor stripes are obtained whose width stability is fully satisfactory, but the edges of the stripes are rather frayed, which, during the operation of the tube, gives rise to considerable hue errors in unfavorable cases, e.g. in a uniform white picture.

It is, therefore, the object of the invention to provide a method of exposure with which sharp-edged phosphor stripes having only slight width variations can be achieved.

This object is achieved by the means set forth in the first claim. After exposure without any filter, as in the first step, stripes are obtained which have very sharply defined edges but no constant width. By the width-correcting second step using a filter, the edge definition is reduced only negligibly; it is much better than in the conventional method, where the total amount of light falls on the screen through a filter.

With the method according to the invention, exposure time is considerably shortened, because the main amount of light falls on the screen without passing through a light-absorbing filter. Total exposure time for both steps is less than one half the exposure time required with the conventional method.

Preferred embodiments are apparent from the subclaims.

DETAILED DESCRIPTION OF THE INVENTION

The invention will now be explained in greater detail with reference to FIG. 2 of the accompanying drawing and with the aid of an embodiment.

Figure 1:
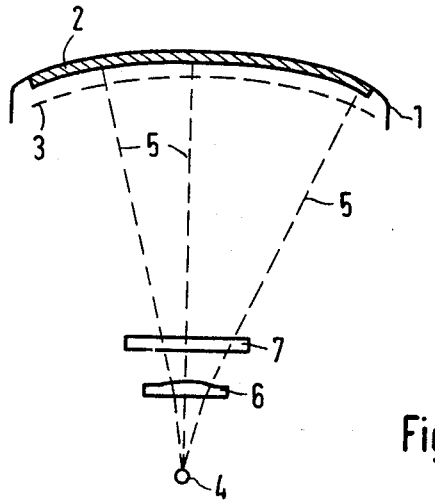
FIG. 1 is a cross-sectional view of the apparatus utilized in the practice of the invention.
Figure 2:
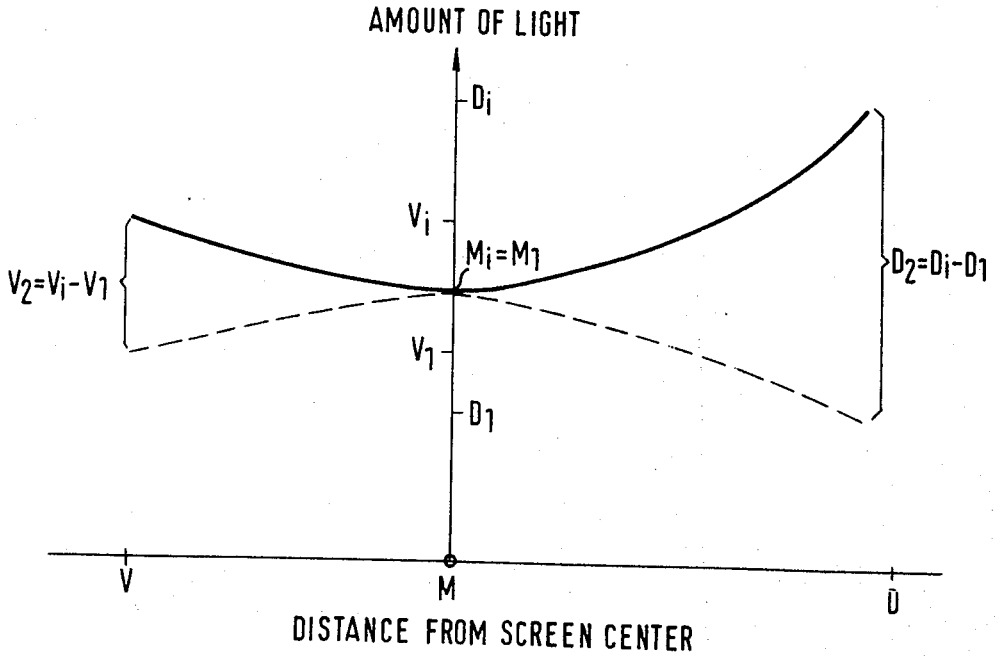
FIG. 2 is a plot showing the amount of light falling on the screen during exposure as a function of the distance from the screen center.

FIG. 2 shows the amount of light falling on the screen during exposure as a function of screen position. The amounts of light are measured on the screen, i.e., behind the shadow mask as viewed from the light source. In a first step, the center M of the screen is exposed to the amount of light $M_1$. At the point D, which is that point on a diagonal furthest from the center, the incident amount of light is $D_1$. This amount is smaller than $M_1$, because the point D is further from the light source than M, and because the transparency of the mask greatly descreases with increasing distance from the center M. The dashed curve on the right-hand side of FIG. 2 shows the dependence of the amount of light striking the screen in the first step on screen position when progressing on a diagonal from M to D. Analogously, the dashed curve on the left-hand side of FIG. 2 shows the dependence of the amount of light when progressing on a vertical line from the center M to a point V which is furthest from M in a vertical direction.

The solid curve shows the dependence of the total amounts of light to which the screen must be exposed in order to achieve the required stripe width at the respective point of the screen.

The center must be exposed to the smallest total amount of light. Toward the outside, greater, but position-dependent amounts of light must fall on the screen. The screen is exposed to the additional amounts of light in a second step. At the center, the total amount of light required, $M_i$, corresponds to the amount of light falling on the screen in the first step, $M_1$. At the point D, however, after the first step, the amount of light $D_i-D_1$ is still required to complete the necessary total amount of light, $D_i$. The screen is exposed to this amount of light $D_2=D_i-D_1$ in the second, corrective step. Analagously, the point V is exposed to the amount of light $V_2=V_i-V_1$, where $V_i$ is the total amount of light required at the point V to achieve the desired stripe width.

The embodiment relates to the exposure of the green phosphor. If the screen is exposed through a gelatin-soot filter by the conventional method, exposure time is 20s. The filter transmission at the center is about 10%.

In the method according to the invention, the screen is exposed in the first step for 1.8 s without any filter, i.e. with 100% transmission 90% of the total amount of light required are thus allowed to fall on the screen. This exposure without filter gives stripes of excellent edge definition but unsatisfactory width stability.

In the second step, a filter is introduced into the light path. Its transmission at the center is 3% and increases from the center toward the outside in such a manner that the correct stripe widths are obtained after the exposure in the second step. During this second exposure, the edge definition of the stripes deteriorates only negligibly; on the whole, it is considerably better than if the total amount of light were caused to fall on the screen through a filter. Exposure time in the second step is 6–7 s. Total exposure time is thus 8–9 s, instead of 20 s with the conventional method.

The embodiment differs from the principle of FIG. 2 in that, in FIG. 2, in the first step, the center is exposed to the total amount of light required, while in the second step, only corrections are made outside the center. In the embodiment, however, the center is exposed to only 90% of the total amount of light in the first step, and to the remaining 10% in the second step. This is due to the fact that filters having zero transmission at the center and a fixed transmission characteristic toward the outside could only be made at high cost. The filter used, as mentioned above, has 3% transmission at the center, which is why in the practical example, the center is exposed in the second step, too.

The filter used may be produced, for example, by any of the methods described in detail in DE-OS No. 20 36 684 or DE-OS No. 20 59 135.

The two-step exposure can be advantageously realized by exposing the screen twice on the same light box ("lighthouse"), but in the first step without a filter and in the second step with a filter slid or turned into the light path.

It is also possible to transfer the glass faceplate to be exposed from a first light box without filter, on which the first step is performed, to a second light box with filter.

The filter may also be of materials other than gelatin-soot. It may also be a filter whose transmission characteristic is determined by different numbers of equally wide opaque zones per area or of opaque zones of different width. Also, diaphragms may be employed which are moved into the light path for different periods of time. In this case, it is particularly advantageous to use a rotating diaphragm having an aperture by which the corrective intensity distribution required in the second step is realized.

I claim:

1. A method of manufacturing luminescent screens for color-picture tubes consisting of two exposure stages, including the steps of:

providing a faceplate coated with a light sensitive layer of luminescent material, providing a shadow mask disposed behind said faceplate, inserting a lens behind said shadow mask, providing a light source behind said lens, activating said light source for a first exposure interval so as to provide light to pass through said lens and said shadow mask to said faceplate in order to provide 90% of the total amount of light required to harden said luminescent material, whereby stripes with sharp edge definition are formed on said coated faceplate, inserting a filter between said mask and said lens, and activating said light source for a second exposure interval so as to provide light to pass through said lens, said filter and said shadow mask to said faceplate in order to complete the hardening of said layer of luminescent material, wherein the transmission of light through said filter increases towards the vertical edges of said filter with the greatest transmission of light at the diagonal edges of said filter, whereby width stability of the stripes is achieved.

2. The method as claimed in claim 1, wherein said filter is a rotating diaphragm having an aperture dependent on the angle of rotation.

3. The method as claimed in claim 1 wherein the two exposure intervals are performed with said faceplate fixed in relation to said light source.

4. The method as claimed in claim 1 wherein the first exposure interval is about 1.8 seconds.

5. The method as claimed in claim 1 wherein the second exposure interval is about 6–7 seconds.

6. A method of manufacturing luminescent screens for colorpicture tubes consisting of two exposure stages, including the steps of:

providing a faceplate coated with a light sensitive layer of luminescent material at a first exposure location, providing a shadow mask behind said faceplate, inserting a first lens behind said shadow mask, providing a first light source behind said first lens, activating said first light source for a first exposure interval so as to provide light to pass through said first lens and said shadow mask to said faceplate in order to provide 90% of the total amount of light required to harden said luminescent material, whereby stripes with sharp edge definition are formed on said coated faceplate, transferring said faceplate and said shadow mask to a second exposure location, inserting a filter behind said shadow mask, inserting a second lens behind said filter, providing a second light source, activating said second light source for a second exposure interval so as to provide light to pass through said second lens, said filter and said shadow mask to said faceplate in order to complete the hardening of said layer of luminescent material, wherein the transmission of light through said filter increases towards the vertical edges of said filter with the greatest transmission of light at the diagonal edges of said filter, whereby width stability of the stripes is achieved.

7. A method of manufacturing luminescent screens for colorpicture tubes consisting of two exposure stages, including the steps of:

providing a faceplate coated with a light sensitive layer of luminescent material at a first exposure location, providing a first shadow mask behind said faceplate, inserting a first lens behind said first shadow mask, providing a first light source behind said first lens, activating said first light source for a first exposure interval so as to provide light to pass through said first lens and said first shadow mask to said faceplate in order to provide 90% of the total amount of light required to harden said luminescent material, whereby stripes with sharp edge definition are formed on said coated faceplate, transferring said faceplate to a second exposure location, inserting a second shadow mask behind said faceplate, inserting a filter behind said shadow mask, inserting a second lens behind said filter, providing a second light source, activating said second light source for a second exposure interval so as to provide light to pass through said second lens, said filter and said second shadow mask to said faceplate in order to complete the hardening of said layer of luminescent material, wherein the transmission of light through said filter increases towards the vertical edges of said filter with the greatest transmission of light at the diagonal edges of said filter, whereby width stability of the stripes is achieved.

* * * * *